United States Patent [19]

Turner

[11] Patent Number: 4,674,245

[45] Date of Patent: Jun. 23, 1987

[54] ROOF WALKWAY PANEL

[75] Inventor: George S. Turner, Conyers, Ga.

[73] Assignee: Diversitech Corporation, Conyers, Ga.

[21] Appl. No.: 822,435

[22] Filed: Jan. 27, 1986

Related U.S. Application Data

[63] Continuation of Ser. No. 591,278, Mar. 19, 1984, abandoned.

[51] Int. Cl.[4] ..... E04B 1/00

[52] U.S. Cl. ..... 52/177; 52/309.12

[58] Field of Search ..... 52/309.4, 309.12, 309.17, 52/177, 181, 41, 384, 302, 533, 612, 596, 408

[56] References Cited

U.S. PATENT DOCUMENTS

| | | | |
|---|---|---|---|
| 2,373,698 | 4/1945 | McGeary et al. | 52/181 X |
| 3,082,489 | 3/1963 | Douglas | 52/602 |
| 3,464,067 | 9/1969 | Hauck | 52/177 |
| 3,466,222 | 9/1969 | Curtis | 52/309.8 |
| 3,653,170 | 4/1972 | Sheckler | 52/309.9 |
| 3,763,614 | 10/1973 | Hyde et al. | 52/309.9 |
| 4,018,944 | 4/1977 | Hallstrom et al. | 52/177 X |
| 4,044,520 | 8/1977 | Barrows | 52/309.12 |
| 4,056,655 | 11/1977 | Faille et al. | 428/451 |
| 4,073,997 | 2/1978 | Richards et al. | 52/309.9 |
| 4,075,805 | 2/1978 | Bongiovanni | 52/309.12 |
| 4,226,060 | 10/1980 | Sato | 52/177 |
| 4,272,211 | 6/1981 | Sabel | 52/181 X |
| 4,274,239 | 6/1981 | Carroll | 52/309.8 |
| 4,318,258 | 3/1982 | Heck | 52/309.12 |
| 4,348,841 | 9/1982 | Ueno et al. | 52/309.12 |
| 4,386,136 | 5/1983 | Kaufmann | 428/451 |
| 4,525,965 | 7/1985 | Woelfel | 52/309.17 |

FOREIGN PATENT DOCUMENTS

| | | | |
|---|---|---|---|
| 2308751 | 11/1976 | France | 52/309.12 |

*Primary Examiner*—J. Karl Bell

*Attorney, Agent, or Firm*—Kenyon & Kenyon

[57] ABSTRACT

A roof walkway panel particularly for use on single ply membrane roofs provides maximum resistance to wear, avoids cutting the membrane and the necessity for reinforcing the membrane, provides a sufficienty high profile, and allows substantial edge-to-edge abutment of adjacent walkway panels. The walkway panel includes an upper concrete wear section and a bottom bonded synthetic foam pad providing resiliency, protection for the roof membrane without bonding and ready portability for the walkway panel.

7 Claims, 2 Drawing Figures

ROOF WALKWAY PANEL

This is a continuation of application Ser. No. 591,278 filed Mar. 19, 1984, now abandoned.

BACKGROUND OF THE INVENTION

Currently, only two types of walkways are being installed on single ply roofing: (1) solid concrete slabs or stepping stones which are laid without adhesive on the roof membrane; and (2) organic sheet compositions containing fabric reinforcements, which are usually adhered to the membrane by an adhesive of the manufacturer's specification.

The advantages of the solid concrete slabs or stepping stones are: (1) low cost, (2) durability, and (3) preclusion of adhesive for bonding to the membrane. The disadvantages are: (1) difficulty of handling, (2) difficulty in elevating onto the roof, and (3) necessity of protecting the roof membrane by laying thereon one or more additional sheets of membrane material under the stepping stones.

Another disadvantage in the use of stepping stones of the prior art type is the necessity of separating them by at least two inch gaps to enable proper water drainage.

The advantages of the prior art organic composition sheets or pads are: (1) ease of handling, and (2) moderate cost. The disadvantages include: (1) bonding to the membrane with adhesive, (2) low profile (½"–1") allowing ballast stone to be kicked or blown onto the pad surface, (3) difficulty of movement to a different location on the roof, (4) long-term degradation by heat and ultra-violet exposure, and (5) the necessity to separate pads by at least two inches for proper drainage.

The objective of this invention, therefore, is to provide an improved roof walkway module or panel which retains the major advantages of the above prior art devices while eliminating their major disadvantages.

In accordance with the present invention, a roof walkway panel is provided which is much easier to handle than solid concrete slabs or stones, does not require gluing to the roof membrane, will not cut or damage the membrane, and is of a permanent non-degradable nature. The walkway panels according to the invention are easily movable to different positions on the roof and can be closely abutted without requiring drainage gaps.

Other features and advantages of the invention will become apparent to those skilled in the art during the course of the following description.

DETAILED DESCRIPTION

Figure 1:
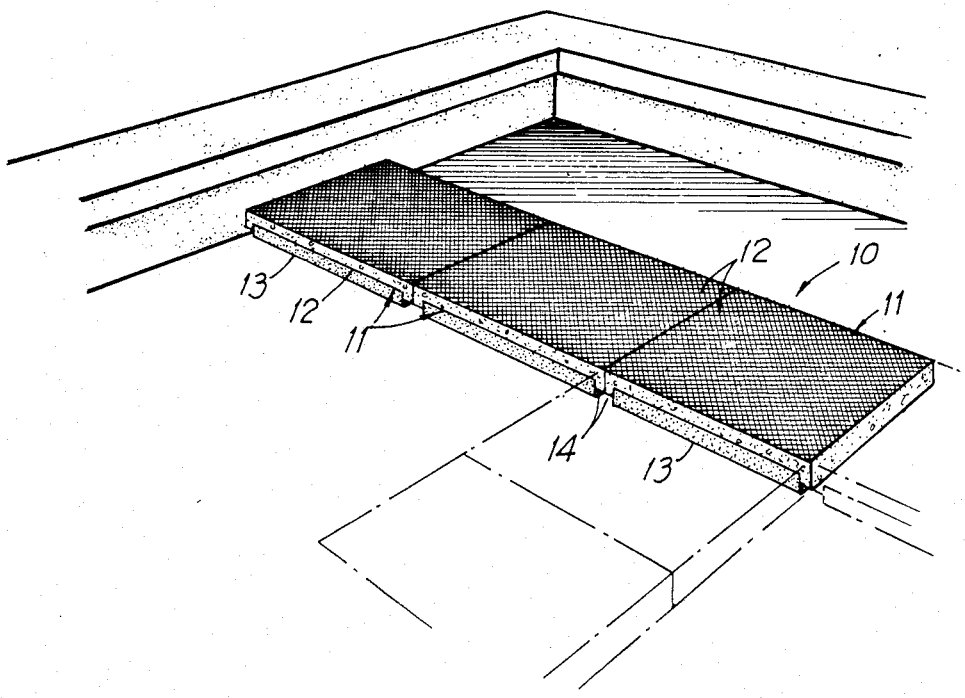
FIG. 1 is a fragmentary perspective view of a roof walkway constructed from panels or tiles according to the present invention.
Figure 2:
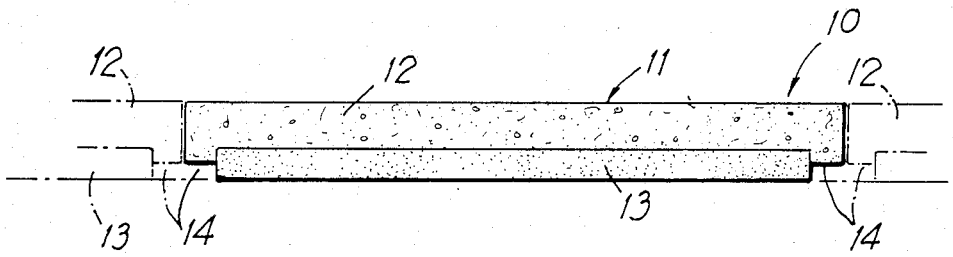
FIG. 2 is a side elevation of a walkway panel according to the invention.

Referring to the drawings in detail wherein like numerals designate like parts, a typical flat single ply roof consisting of a membrane on which slag or ballast stone is placed is illustrated. A roof walkway 10 of any desired configuration constructed according to the present invention is also shown in the drawings. This walkway is constructed from any required number of preferably square walkway panels or tiles 11, whose construction forms the main subject matter of the invention.

Each panel 11 comprises an upper wear section 12 molded from concrete in accordance with one of the following preferred formulations:

| | MATERIAL | PROPORTION (by Weight) |
|---|---|---|
| Formula #1 | Sand | 700 |
| | Portland Cement | 700 |
| | Chopped Fiber Glass Strand | 32 |
| | Commercial Plasticizer | 4 |
| | Commercial Detergent | 1 |
| | Water | 200 |
| Formula #2 | Sand | 700 |
| | Pea Stone | 400 |
| | Portland Cement | 700 |
| | Chopped Fiber Glass Strand | 40 |
| | Commercial Plasticizer | 4 |
| | Commercial Detergent | 1.2 |
| | Water | 200 |
| Formula #3 | Sand | 700 |
| | Pea Stone | 700 |
| | Portland Cement | 700 |
| | Chopped Fiber Glass | 20 |
| | Chopped Polypropylene Fiber | 10 |
| | Commercial Plasticizer | 5 |
| | Detergent | 1.5 |
| | Water | 260 |

The purpose of the chopped fiber glass or other fiber in these formulations is to enhance the flexural and impact strength of the panel. The plasticizer lowers the water requirement, thus increasing compressive strength. The detergent lowers the density of the mix by entraining air, improves its workability, and relieves the surface tension of the liquid component allowing a tight bond of the upper section 12 with the underlying foam pad or board, yet to be described.

Preferably, the upper wear section 12 is scored on its top face during casting to produce a roughened tread surface to aid foot traction in wet or icy conditions. Typically, the upper section 12 is one and one-half inches thick although this dimension can be varied somewhat. The rectangular dimensions of the product can be varied to meet the needs of particular applications.

The walkway panel further comprises a bottom section 13 of uniform thickness, typically one inch, formed of polystyrene board. The bottom section 13 can be "beadboard" or the product may be extruded. It has a bulk density of from one to three pounds per cubic foot. The compressive strength of the polystyrene board is typically 1200–1400 pounds per square foot for a one pound beadboard.

As shown in the drawings, the bottom polystyrene section 13 is recessed into the bottom face of the upper concrete section 12 a distance of about one-half inch, rendering the total thickness of the module or panel 11 approximately two and one-half inches overall. An approximate one inch wide drain recess 14 is thus formed entirely around the rectangular perimeter of each walkway panel. When adjacent panels are laid down in nearly edge abutting relationship, multiple drain slots measuring two inches wide are created entirely across the walkway between each pair of walkway panels or tiles.

The overall bulk density of each panel 11 constructed according to the invention is about 70 pounds per cubic foot, which is considerably lighter than panels formed from conventional solid concrete.

In each walkway panel 11, the bottom polystyrene board section 13 is permanently and tightly bonded in a conventional manner to the bottom of the upper concrete wear section 12.

In use, the improved walkway sections or tiles are simply placed in any desired configuration on the flat roof and do not require bonding to the roof and will not cut or otherwise damage the single ply roof membrane, as previously explained. The polystyrene bottom board section 13 provides some cushioning while the top scored concrete section 12 is extremely durable and resistant to wear, flexurre and impact. The panels are light enough to be elevated and handled much more easily than conventional stepping stones.

A walkway constructed with the panels 11 provides excellent drainage and has a high enough profile to prevent the scattering of ballast stone onto the walkway tread surface.

The many advantages of the invention over the prior art should now be apparent in view of the foregoing description.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A roof paver system comprising:

a roof top base;

a plurality of panel sections disposed on said base without bonding thereto wherein adjacent panels are in substantial edge to edge abutment to one another;

each panel comprising an upper concrete slab section and a lower slab-like section of somewhat resilient cushioning material wherein said lower slab-like section is attached to and projects downward from said upper concrete slab section and said lower slab-like section has a bottom face in non-bonded contact with said base; and drainage recess means provided below said upper concrete slab section in at least some of said plurality of panels.

2. A roof paver system according to claim 1 wherein at least some of said upper concrete slab sections are top scored.

3. A roof paver system according to claim 1 wherein said lower slab-like section is formed from synthetic foam material.

4. A roof paver system according to claim 1 wherein said lower slab-like section is formed from foamed plastic material.

5. A roof paver system according to claim 1 wherein said lower slab-like section is formed from polystyrene beadboard.

6. A roof paver system according to claim 1 wherein said base contacted by said bottom face of said lower slab-like sections is the membrane of a single ply roof.

7. A roof paver system according to claim 1 wherein said upper concrete slab sections have a bottom face with a recess receiving therein respective lower slab-like sections.

* * * * *